United States Patent [19]

Görike et al.

[11] Patent Number: 5,073,936

[45] Date of Patent: Dec. 17, 1991

[54] STEREOPHONIC MICROPHONE SYSTEM

[75] Inventors: Rudolf Görike, Sternwartestrasse 57c, A-1180 Vienna; Fritz Sippl, Vienna; Sandor Szabo, Klosterneuburg-Kierling, all of Austria

[73] Assignee: Rudolf Görike

[21] Appl. No.: 449,298

[22] Filed: Dec. 5, 1989

Related U.S. Application Data

[63] Continuation of Ser. No. 283,180, Dec. 12, 1988, abandoned.

[30] Foreign Application Priority Data

Dec. 10, 1987 [AT] Austria ..... 3249/87
Feb. 29, 1988 [AT] Austria ..... 521/88

[51] Int. Cl.[5] ..... H04R 5/027
[52] U.S. Cl. ..... 381/26
[58] Field of Search ..... 381/26

[56] References Cited

U.S. PATENT DOCUMENTS 4,308,426 12/1981 Kikuchi ..... 381/155
4,388,494 6/1983 Schöne et al. ..... 381/26

*Primary Examiner*—Forester W. Isen
*Attorney, Agent, or Firm*—Toren, McGeady & Associates

[57] ABSTRACT

A stereophonic microphone system for improving stereophonic hearing utilizes intensity stereophonic and/or time difference stereophonic pickup methods with the use of replicas of the human head. The microphones are mounted in the replicas of the outer auditory meatus. The replica of the human head is limited to replicas of the pinna with outer auditory meatus. In addition to the known stereophonic recording device used as a position association stage, two replicas of human pinnas are used, with pressure microphones in each opening of the auditory meatus as a shape association stage. The pinna replicas are arranged spaced apart and oriented on the human head or closely next to each other with the same orientation. The pinna replicas are arranged preferably immediately adjacent the arrangement of known directional microphones for the interaural sound recording in the horizontal and median planes. As a result, in addition to the proven technology of intensity and/or delay stereophonics in the frequency range below approximately 1500 Hz, interaural resonances become effective in the horizontal and vertical plane through the pinna replicas in the frequency range above approximately 1500 HZ. It is significant that here signals are created which are as incoherent as possible in order to avoid, particularly in head set reproduction, a localization in the head or the proximity effect at the ears.

9 Claims, 7 Drawing Sheets

Fig. 13
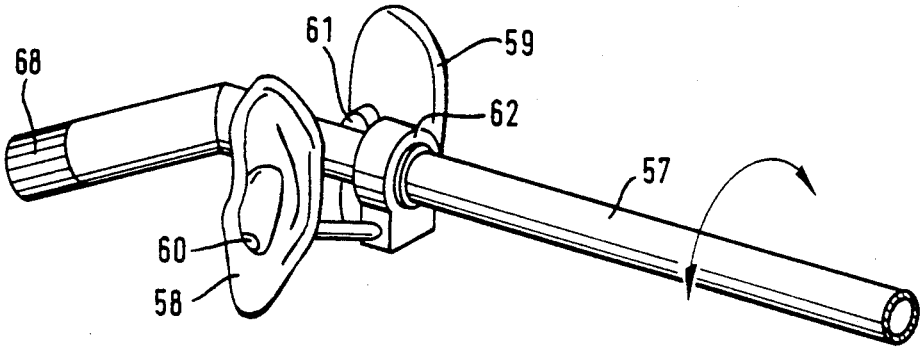
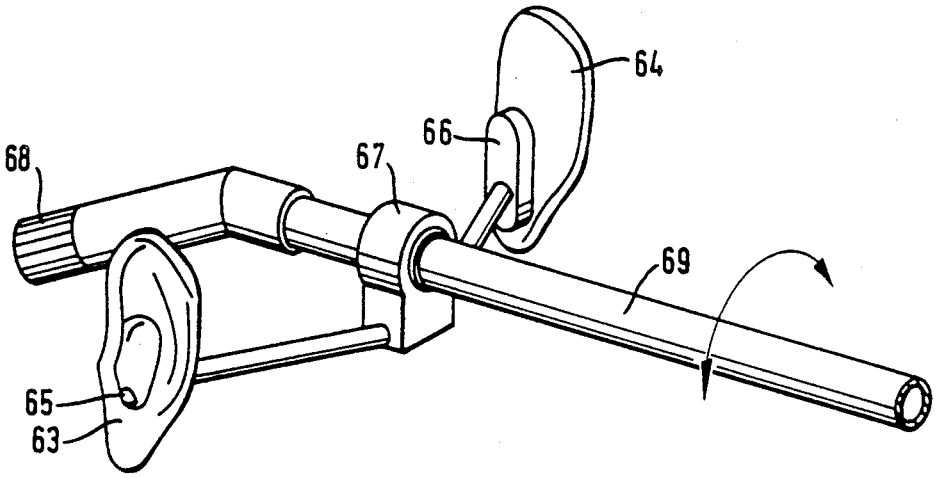
Fig. 14

STEREOPHONIC MICROPHONE SYSTEM

This is a continuation of Ser. No. 07/283,180 filed Dec. 12, 1988, abandoned.

BACKGROUND OF THE INVENTION

1. Field of the Invention

The present invention relates to a stereophonic microphone system for improving stereophonic reproduction. The microphone system utilizes interaural intensity stereophonic and/or time difference stereophonic pickup methods.

2. Description of the Related Art

Stereophonic recording methods using interaural intensity and/or time difference stereophony are known. However, the reproduction takes place generally only by using loudspeakers in basic stereo placement or by means of headsets. These types of reproduction have the disadvantages of space-related stereophony.

Among these pickup methods are the XY-method using two cardioid microphones which are placed closely next to each other at an angle of 90° to 135°; the MS-method using a cardioid microphone and a bidirectional microphone arranged at a right angle to the cardioid microphone; the AB-method with two pressure pickups spaced apart 20 to 330 cm for obtaining the effect of arrival time differences; the ORTF-method with two cardioids spaced approximately 17.5 cm from each other and at an angle of 100° to 140°; the OSS-method according to Jecklin with a separation disk and pressure pickups arranged in front of both sides; and the dummy head method utilizing replicas of the human head with the ears.

None of the known pickup methods was capable of meeting the requirements for compatibility of loudspeaker and headset reproduction. Also, a spatial impression which would come close to that of natural hearing, for example, in a concert hall, has never been achieved. In the case of loudspeaker reproduction, the hearing illusion remains in the plane of the loudspeaker laterally limited by the area between the loudspeakers or raised above the connecting line of the loudspeakers. The headset reproduction suffers from the localization in the head or at least a hearing illusion created near the ear. Although an artificially created reverberation simulates some spatial effect, however, this effect is not comparable to the hearing event in a concert hall.

With the exception of the dummy head technology, ear resonances are not created during sound pickup as well as during reproduction in accordance with the interaural intensity and/or time difference methods. The resonances generated at the ears of the listener by means of the loudspeakers in basic stereo placement are limited to the direction of incidence of each loudspeaker and serve merely as a localization stimulation of the location-determining reproducing transducers (the loudspeakers). In the case of a loudspeaker reproduction in a room, the reflections from the walls generate ear resonances from all directions of incidence, however, these reflections are only perceived as reverberations. In the case of reproduction by means of headsets, only ear resonances with proximity effects are created because of the structural design of headsets, particularly due to the orientation of the diaphragm, even if no reflections occur due to the small coupling space and the acoustically stiff components of the transducer.

It is, therefore, the primary object of the present invention to provide a stereophonic microphone system which, in supplementing the sound field pickup technology of the past, generates an additional sound field information by using replicas of human ears which provide a characteristic multitude of ear resonances necessary for the perception of incidencies from all horizontal and vertical directions.

SUMMARY OF THE INVENTION

In accordance with the present invention, the replica of a human head is limited to replicas of the pinna with outer auditory meatus. In addition to the known stereophonic sound pickup device used as a position association stage, two replicas of human pinnas are used preferably with pressure microphones in each opening of the auditory meatus as a pinna transfer function pickup device. The replicas of the pinna are arranged either spaced apart and oriented as on the human head or are arranged closely next to each other with the same orientation as on the human head. The replicas of the pinna are arranged preferably immediately adjacent to the known directional microphones for the interaural intensity or time difference sound pickup in the horizontal and vertical plane, representing (or forming) an integral part of the known sound pickup devices.

In accordance with the acoustics of operation of dummy head stereophony in the frequency range of below approximately 1500 Hz, interaural time and intensity differences between the left to right headside ratio of only 8 dB occur due to the dimensions of the dummy head. The pickup device according to the present invention, on the other hand, permits a left to right headside ratio or interaural difference of approximately 20 to 30 dB which is generally demanded today.

In accordance with the present invention, in addition to the known interaural intensity and/or delay time difference in the frequency range of below approximately 1500 Hz, the pinna transfer functions become effective in the horizontal and vertical plane in the frequency range above approximately 1500 Hz. Also, ear resonances provide full orientation, while the directional pickup effects of the known stereophonic method is utilized primarily in the range below approximately 1500 Hz. It is of importance that stereo signals are created which are as incoherent as possible in order to avoid, particularly in the case of headset reproduction, an in the head localization a—1 proximity effect at the ears.

In accordance with another development of the present invention, the two replicas of human pinnas including the pressure pickups are arranged so as to be rotatable around the longitudinal axis thereof, while the usual microphones for interaural intensity and time difference stereophony recording in the frequency range of below approximately 1500 Hz remain in a fixed position.

By rotating the pinnas around the longitudinal axes, aural spatial and distance impressions are obtainable due to the influence of ear resonances becoming effective by specific wall reflections.

In accordance with another feature of the present invention, in addition to the two pinna replicas with pressure microphones mentioned above, additional pinna replicas in different directions preferably with pressure microphones are provided for creating an additional listening illusion in the superimposed sound field.

The use of more pinna replicas results in a further improvement of spatial listening effects.

Finally, it is advantageous if the transmission range of the amplitude frequency response is controllable, e.g., also by remote control, by means of electrical low-pass and high-pass filters either of analog or digital function for optimizing the listening illusion.

The adjustment by means of filters has the advantage that the effect of the ear resonances obtained by the pinna replicas which are essentially above 1500 Hz are maintained, while the pickup effect with a left to right headside ratio of up to 30 dB.

Another further development of the invention relates to a microphone system utilizing pinna replicas for the stereophonic pickup of sound events with adjustable stereo base width, particularly in accordance with the MS-microphone method in reduced arrangement of transducer elements. In this further development, the microphones mounted in the outer auditory meatus replicas are directional microphones, preferably with bidirectional characteristics. At least one additional directional microphone is provided which is arranged in a horizontal direction perpendicularly between the microphones of the pinna replicas. The outputs are electrically connected, so that the two directional characteristics generated by sum and difference are obtained in usual stereo base width.

In the microphone system according to the present invention it is achieved that, with a variable stereo base angle, particularly according to the MS-microphone, technique the interaural ear resonances from the pinna replicas are created three-dimensionally as on the natural human head because of the symmetrical orientation. If all microphones of the present application have unidirectional pickup characteristics, the signals of each of the pinna microphones is connected to one of the signals of the unidirectional microphones forwardly. This results in substantial possibilities of influencing the sound by obtaining interaural ear resonances especially in view of the stereo applications.

On the other hand, if the microphones arranged in the pinna have a bidirectional characteristic, i.e., a pickup characteristic directed to both sides, the interaction of the signal having two preferred directions with the unilaterally directed additional signal results in particularly favorable conditions for the authentic transmission of the acoustic events with the simultaneous realization of interaural ear resonances. This makes it further possible to influence the width of the stereo base of the pickup characteristics.

The pinna replicas are either exact reproductions of the human pinnas or are only provided with those components which are important for generating the resonances, such as, cavum conchae, helix and/or antihelix.

The MS-microphone method used in particular in accordance with the present invention with the utilization of pinna replicas at the microphones with preferably bidirectional pickup characteristics provides the pinna transfer function in accordance with the orientation of the pinna replicas. At a right angle thereto, the microphone with unidirectional pickup characteristic acts through vectorial combination with the two other microphones, however, without ear resonance pickup. While in the frequency range of below approximately 1500 Hz the pickup pattern is created with a variable angle, the pinna replicas result in directional pinna transfer functions exactly in the same direction as according to a human head.

In order to obtain interaural time differences in addition to the interaural intensity difference level which is important for the spatial hearing, it is advantageous in accordance with another embodiment of the invention to mount the two replicas of the human ear with microphones therein at a distance a of approximately 18 cm therebetween and oriented in accordance with the ears on the human head and immediately adjacent to the ear replicas a microphone each with unidirectional pickup pattern at an angle of 90°. As a result of this measure, a microphone with unidirectional pickup pattern is arranged immediately adjacent to each ear replica at a right angle thereto, so that a left to right headside ratio of 30 dB is obtained with altered base width.

In accordance with another useful feature of the present invention, the microphones with the replicas of the human pinna are arranged spaced apart approximately 18 cm and mounted on a microphone boom in such a way that the microphones do not change direction when the boom is rotated, while a directional microphone between the ear replicas points to a selected sound source by rotating the boom during sound pickup.

It is of a particular advantage if the above-described arrangements are mounted on a microphone boom for recordings in film and television, so that a variable large pickup angle and base width is obtained while maintaining the ear resonance pickup with the support of a microphone control unit or a correlation factor meter. In deviating from the strict MS-microphone microphone technique, the stereophonic pickup for television can be effected in such a way that the microphones with ear replicas are used with full stereophonic base width to create a good atmosphere for off-screen sounds which do not seem to come from the direction of the screen and for music, while the visible performers, i.e., actors and singers, the base width is narrowed in such a way that their voices appear to come from the screen.

It has further been found very useful for the entire pickup method if the microphones are controlled from an individual microphone unit or by a correlation factor meter. This has the advantage that the entire recording activity can be observed and influenced from a central operating position without requiring outside help.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention

BRIEF DESCRIPTION OF THE DRAWING

In the drawing:

FIGS. 13 and 14 are perspective views of devices according to the present invention used on microphone booms.

DESCRIPTION OF THE PREFERRED EMBODIMENT

Figure 1:
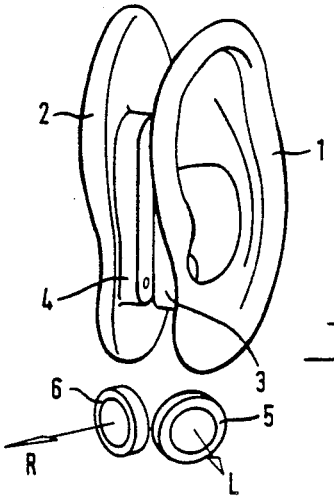
FIGS. 1-4 are schematic perspective views of different embodiments of the stereophonic microphone system according to the present invention.

In FIGS. 1-14 of the drawing, for clarity's sake only the structural components of the microphones are shown which are important for the acoustic operation thereof.

In FIG. 1 of the drawing, two pinna replicas 1 and 2 are illustrated. In the conventional manner, the cavities of the pinna replicas are constructed strictly following the shape of the human ear while the outer ear may be constructed with the omission of superfluous details. The pinna replicas 1 and 2 are arranged aligned as on the human head with pressure pickups 3, 4, preferably electrostatic transducers, arranged in the opening of the auditory meatus or at the end of the auditory meatus.

It is advantageous to arrange underneath each pinna a microphone capsule 5, 6 of preferably also an electrostatic transducer, however, with a cardioid characteristic. The microphone capsules 5, 6 are oriented at with 90° to 135° in between known XY-arrangement.

Figure 2:
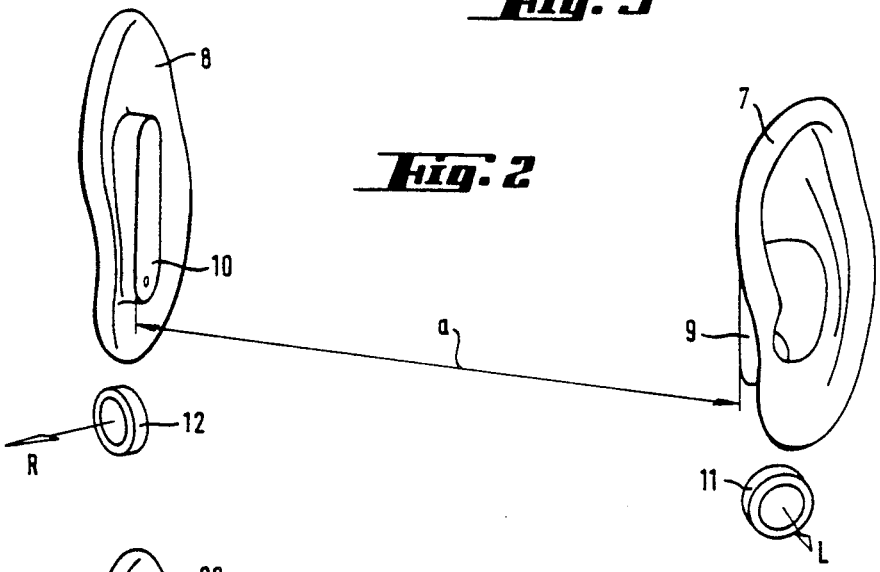

FIG. 2 of the drawing shows two pinna replicas 7, 8 which are spaced apart approximately 18 cm. Pressure pickups 9, 10 are mounted in the pinna replicas 7, 8 and underneath each pinna replica is mounted a cardioid microphone 11, 12 oriented with an angle of 100° to 140° therebetween in accordance with the ORTF-technique.

Figure 3:
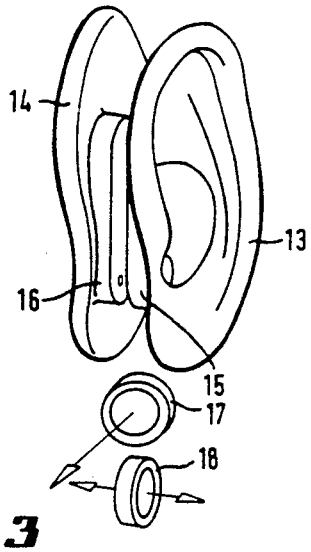

FIG. 3 shows an arrangement according to the known MS-technique utilizing two pinna replicas 13, 14 with pressure pickups 15, 16. Underneath the pinna replicas are provided a cardioid microphone 17 and a microphone 18 having unidirectional pickup characteristic which serves in the known manner through electric coupling for obtaining two cardioids at variable angles.

Figure 4:
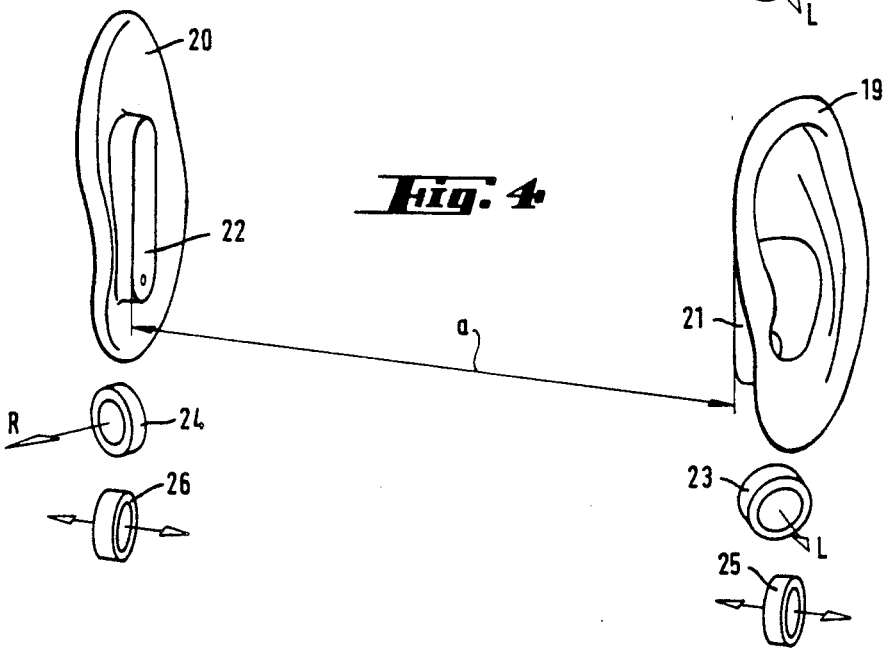

FIG. 4 of the drawing shows the use of the MS-technique in conjunction with two pinna replicas which are spaced apart approximately 18 cm. In this embodiment, the pinna replicas are not only arranged as oriented in the human head, but they are also arranged spaced apart as on the human head. Pressure pickups 21, 22 are mounted in the pinna replicas. Underneath each pinna is arranged a cardioid microphone 23, 24 and, immediately adjacent thereto, the microphones 25, 26 with unidirectional pickup characteristics which are coupled in accordance with the MS-technique.

Figure 5:
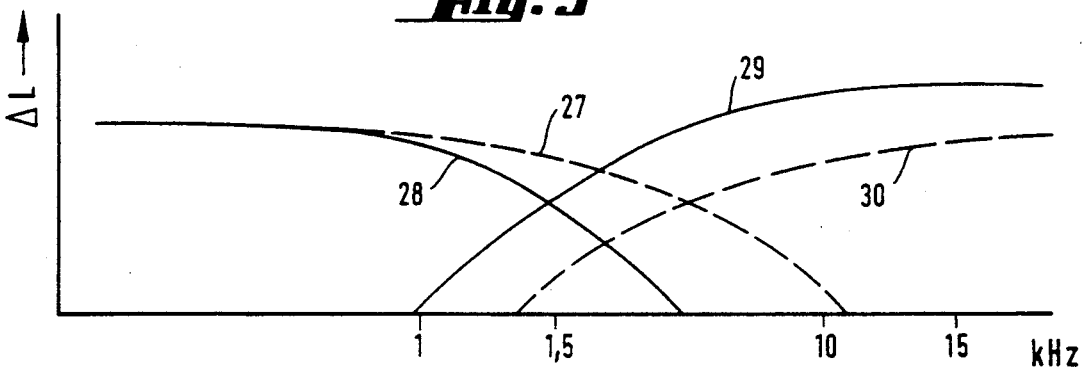
FIG. 5 is a diagram showing low-pass and high-pass filter curves of the microphones used in accordance with the invention.

FIG. 5 shows low-pass filter curves 28, 29 of the microphones for the range below 1500 Hz and high-pass filter curves 27, 30 for the pressure pickups mounted in the ears. The microphones do not have to be arranged next to each other but may also be arranged one below the other. It must be ensured, however, that the distance between the sound transducers is maintained as small as possible.

In order to prevent interferences to group delay and phase distortions in the range of intersection of the frequency curves, analog high-pass and low-pass filters as well as digital technology ca be used.

Figure 6:
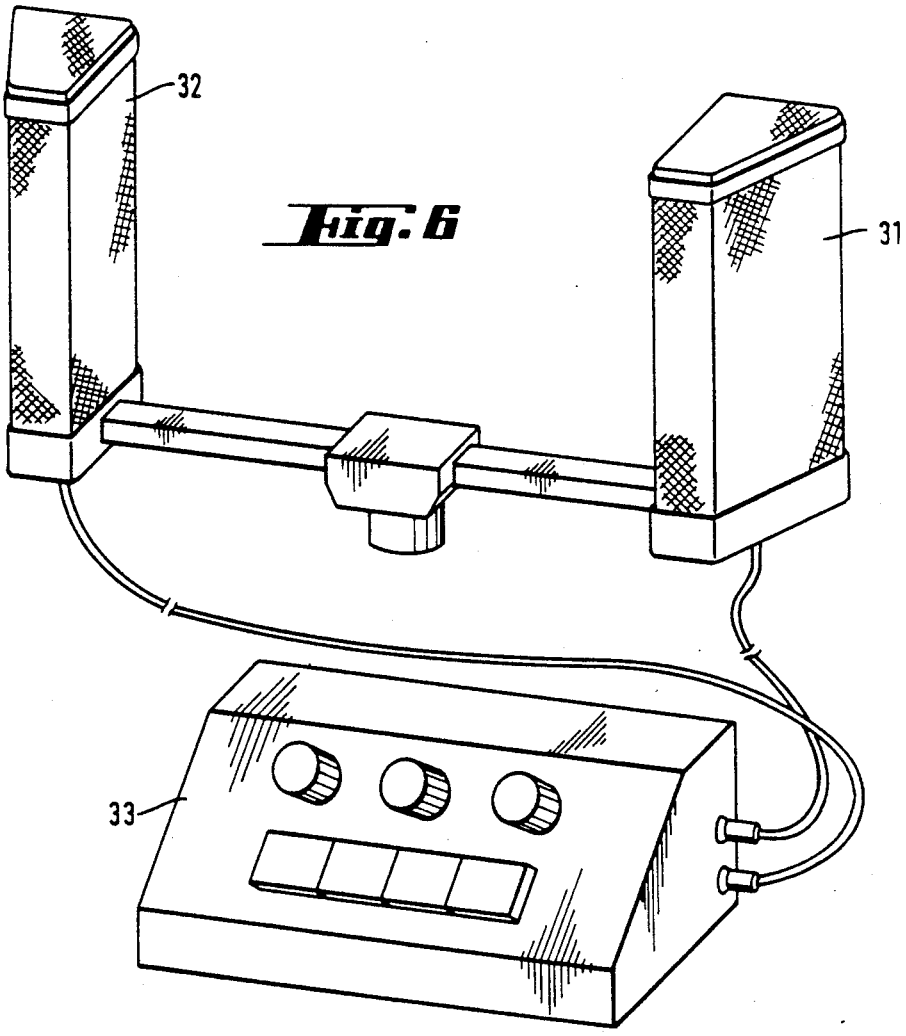
FIG. 6 is a view of a stereophonic microphone system according to the present invention with a microphone control unit.

FIG. 6 of the drawing shows a stereophonic recording device according to the present invention in conjunction with a device 33 for a microphone control unit. By being spaced apart from each other, the microphones 31, 32 are adjusted to the ORTF-technique or the MS-technique with interaural time difference effects.

Figure 7:
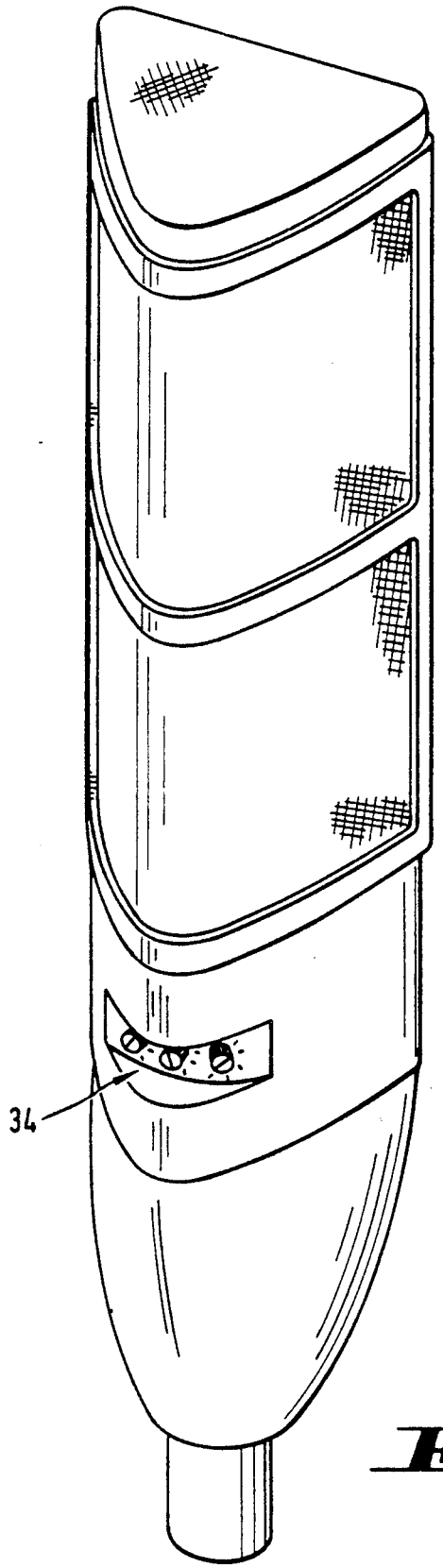
FIG. 7 is a perspective view of a housing for the recording device according to the present invention.

FIG. 7 is a perspective view of a microphone according to the present invention which operates in accordance with the XY-technique or the MS-technique. The low-pass filters and the high-pass filters are mounted in the microphone housing. Control members 34 serve for optimizing the auditive spatial impression.

The microphones used in the stereophonic pickup device according to the present invention together with the replicas of human pinnas can be used as principal microphones as well as supporting microphones. A large variety of the simulation of spatial hearing is possible due to the large selection of acoustic effects, such as, artificial reverberation, controllable time differences, number of different microphones and utilization of subjective possibilities on the mixing unit.

Figure 8:
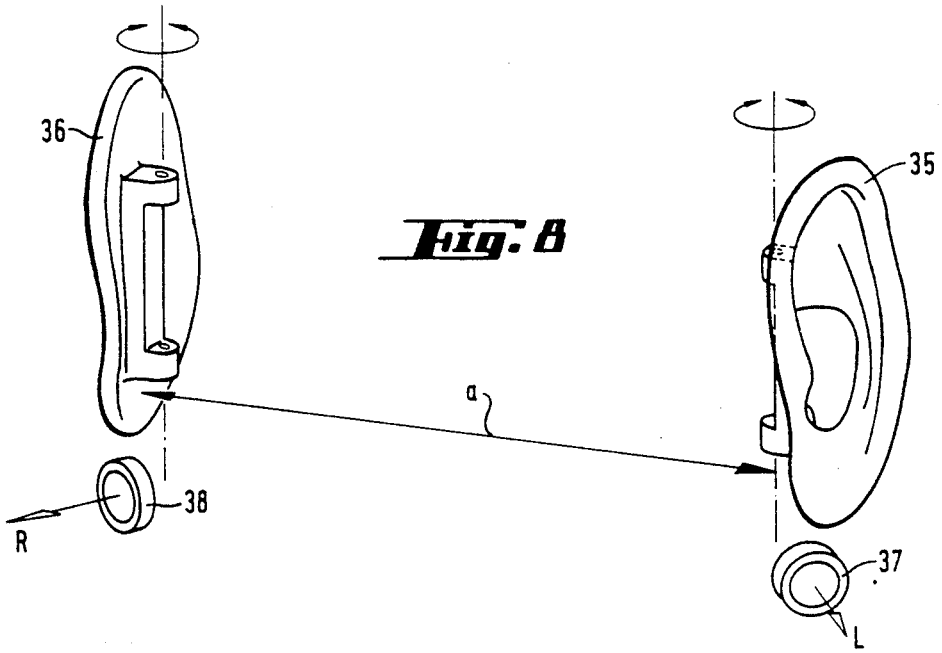
FIG. 8 is a schematic illustration of the manner of operation of an embodiment of the present invention.

FIG. 8 of the drawing schematically illustrates a manner of operation which deviates from the natural listening procedure of the human head. Actually, the method of spatial hearing used by animals is utilized. By rotating the pinna replicas 35, 36 around the longitudinal axis, aural spatial impressions and distance listening become effective due to the influence of specific small reflections with preferred ear transfer functions. The directional microphones 37, 38 are arranged in the known orientation and may be effective over the entire frequency range. In addition, the ear resonances may produce in any orientation of the microphone previously known effects of spatial hearing.

Devices with more than two pinna replicas in different orientations can be used in addition to known stereo microphone methods for influencing the listening illusions in conjunction with a pickup correction or with an improvement of the playback acoustics in order to obtain superpositions of ear resonances. It may be useful to shape the signals on the right and on the left differently in order to generate uncorrelated ear signals in conjunction with lateral reflections of the listening room. By means of the ear resonances it is possible to bring in certain instruments of an orchestra more closely because ear resonances create more presence without increasing the loudness level.

Figure 9:
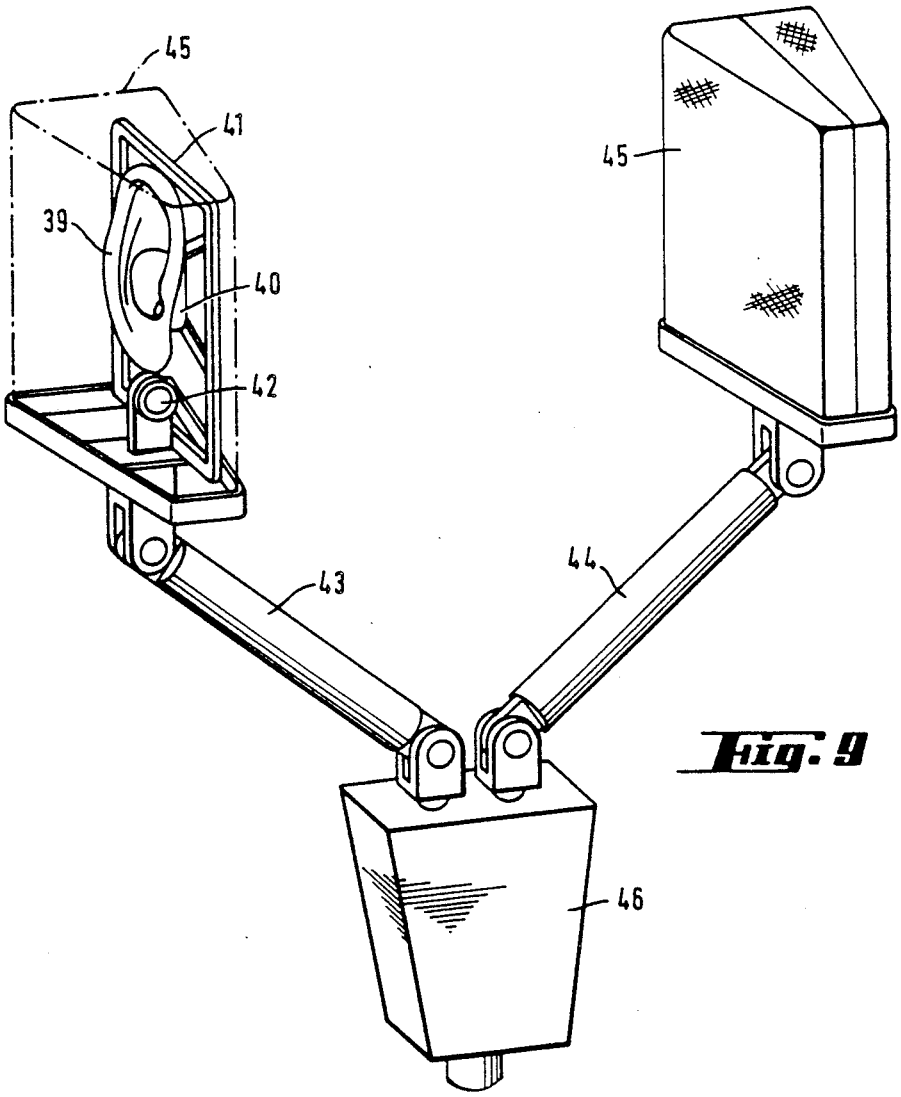
FIG. 9 is a perspective view of a stereo microphone using the features of the present invention.

FIG. 9 of the drawing illustrates a stereo microphone including the features of the present invention. To better explain the invention, the microphone with the right ear replica is shown without protective screen and the other with protective screen 45. The replica of a human ear 39 with pressure pickup 40 is elastically mounted in a frame 41. The cardioid microphone 42 is arranged immediately below the pinna. The microphone combination is pivotally supported by means of arms 43 and 44, so that the distance can be adjusted in accordance with the ears of the human head, i.e., approximately 18 cm apart. A completely sound-permeable screen cage 45 ensures the unimpaired sound passage. The electrical components for the stereo transmission are housed in housing 46.

Figure 10:
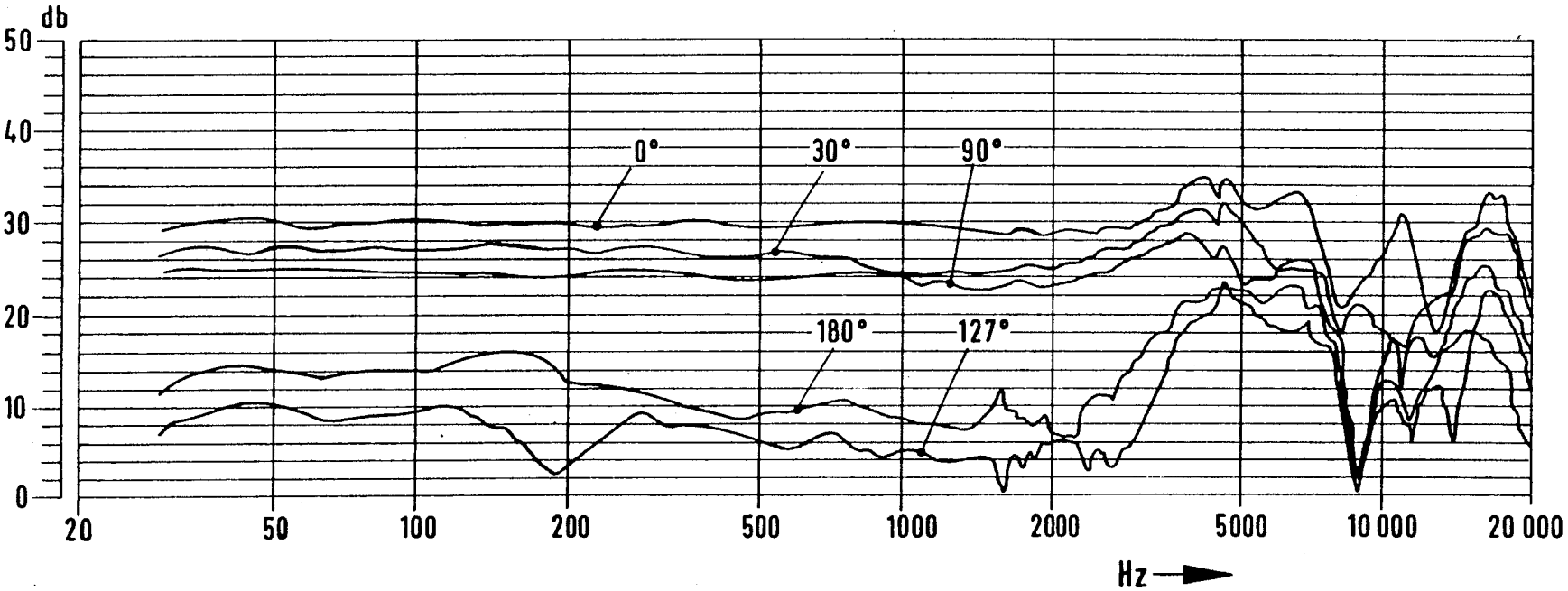
FIG. 10 is a diagram illustrating the monaural transmission function of a device according to the present invention.

In the diagram of FIG. 10, the monaural transmission function of a device according to the present invention is illustrated. As can be seen, in the frequency range below 1500 Hz the level difference for the different directions of sound incidence correspond to that of a known cardioid microphone with a left to right head-side ratio front to back discrimination of 20 to 30 dB, while above 1500 Hz the monaural direction-dependent characteristic ear resonances become effective. However, the illustration of FIG. 10 is further improved because the ear replicas cover the vertical plane in addition to the horizontal a perfect simulation of natural ear impression is obtained which effect which otherwise is only possible in digital technology with complicated and expensive equipment.

Figure 11:
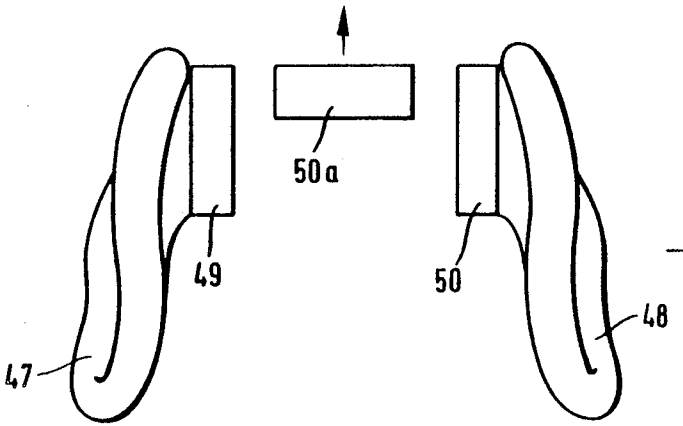
FIGS. 11 and 12 are illustrations of two pinna replicas used in embodiments of the device according to the present invention.

FIG. 11 of the drawing shows two pinna replicas 47, 48 arranged closely next to each other but oriented on the human head. Microphones 49, 50 with preferably unidirectional pickup characteristics are mounted in pinna 47, 48. An additional microphone 50*a* with unidirectional pickup pattern is arranged at an angle of 90° relative to the two other microphones. The pinna replicas 47 and 48 are mounted at such a distance from each other that no harmful influence on the sides of the pinna replicas 47, 48 is created and the microphones 49, 50 for obtaining the preferably unidirectional pickup pattern are subjected on the rear side to the sound effects of the room. The microphone 50*a* with unidirectional pickup pattern is arranged in the plane of symmetry of the microphones 49, 50.

The replicas of the pinnas can also deviate from the exact shape of the natural pinnas of the human head. Only the equivalent acoustic effect of the cavum conchae, helix, antihelix, etc. are of significance.

Figure 12:
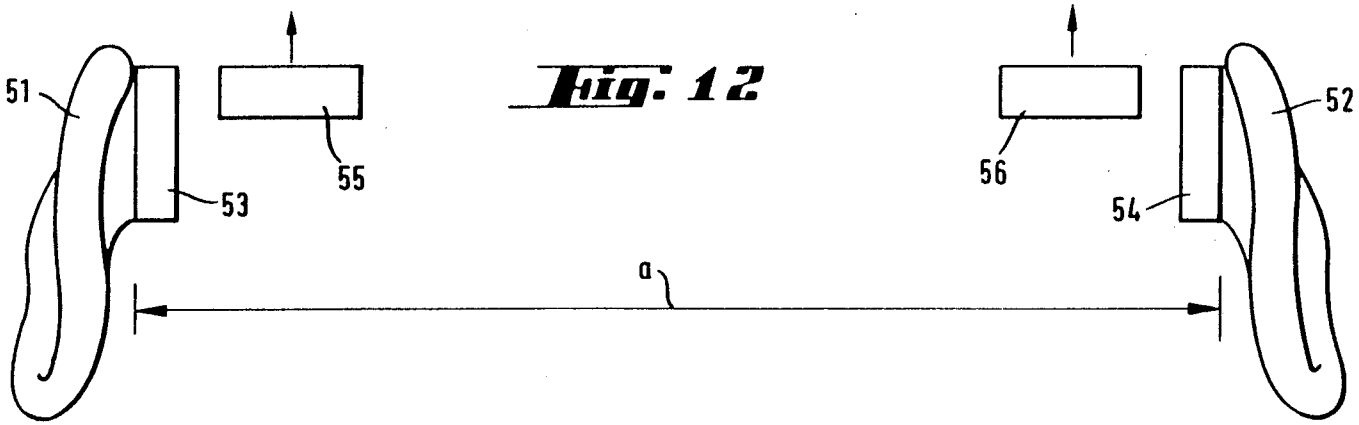

In FIG. 12 of the drawing, two pinna replicas 51, 52 with microphones 53, 54 are illustrated. The arrangement shown in FIG. 12 pickup interaural time differences in addition to interaural intensity differences. The pinnas 51, 52 are arranged at a distance a from each other of about 18 cm in accordance with the distance between the ears of the human head. In order to obtain variable pickup characteristics in cardioid or hypercardioid characteristics, a microphone 55, 56 with unidirectional pickup characteristic is arranged immediately adjacent each pinna. A stereo base angle of 90° to 130° is adjustable.

FIGS. 13 and 14 show for use for film and television a functionally slightly different operation in the use of two replicas of human pinnas and a microphone with preferably unidirectional pickup pattern.

The present invention is of particular significance for obtaining congruence between image and sound in stereophonic sound pickup in television. Because of the required rapid action on the screen, it is advantageous to control the image on the screen and the surroundings in accordance with the sound events. Used for this purpose are the two pinna replicas with the microphones which may have hypercardiod to cardioid characteristics instead of bidirectional characteristics particularly for sound events which are located outside of the screen. For the production on location, the directional microphone 68 can be directed toward the actors by rotating the boom 57 for mono on screen information, while fixed microphones 60, 61 provided with pinnas 58, 59 serve by means of an appropriate support 62 on the boom for spatial information on events outside of the screen. FIG. 14 shows an extension of the acoustic effects by including arrival time differences. The pinna replicas 63, 64 with microphones 65, 66 are maintained at a distance of about 18 cm therebetween in fixed horizontal position in the recording room by means of the support 67, while the microphone 68 can be oriented by rotating the boom 69.

Finally, it is advantageous if the microphones can be distant controlled through a mixing unit or through a correlation factor meter.

While a specific embodiment of the invention has been shown and described in detail to illustrate the application of the inventive principles, it will be understood that the invention may be embodied otherwise without departing from such principles.

We claim:

1. A stereophonic microphone system comprising, stereophonic sound pickups, two replicas of human pinnas, a replica of an outer auditory meatus being connected to each pinna replica, a pressure microphone being mounted in each pinna replica so as to close off each auditory meatus, each pressure microphone having an ear resonance which is effective by electrical admixing with outputs of said stereo pickups, the microphones with pinna replicas being arranged spaced apart and oriented as on the human head.

2. A stereophonic microphone system comprising, stereophonic sound pickups, two replicas of human pinnas, a replica of an outer auditory meatus being connected to each pinna replica, a pressure microphone being mounted in each pinna replica so as to close off each auditory meatus, each pressure microphone having an ear resonance which is effective by electrical admixing with outputs of said stereo pickups, the microphones with pinna replicas being arranged spaced apart and arranged closely next to each other oriented symmetrically about a plane of symmetry .

3. The stereophonic microphone system according to claims 1 or 2, the pinna replicas having a longitudinal axis each, wherein the pinna replicas including the pressure microphones are arranged so as to be rotatable about the longitudinal axes thereof.

4. The stereophonic microphone system according to claims 1 or 2, comprising a low-pass filter for the stereophonic sound pickups and a high-pass filter for the pressure microphones with pinna replicas with a transfer frequency of approximately 1500 Hz.

5. The stereophonic microphone system according to claims 1 or 2, for recording sound events with adjustable stereo base width in accordance with the MS-microphone technique, wherein the microphones mounted in the outer auditory meatus replicas are microphones with directional response pattern, and at least one microphone with unidirectional pickup effect is provided arranged in horizontal position perpendicularly relative to the microphones of the pinna replicas, the outputs of the microphones being electrically connected, so that directional characteristics in stereo base width are generated by the formation of sums and differences.

6. The stereophonic microphone system according to claim 5, wherein the microphones with directional response pattern in the outer auditory meatus replicas have unidirectional pickup characteristics.

7. The stereophonic microphone system according to claim 5, wherein the pinna replicas with the microphones mounted therein are arranged at a distance of approximately 18 cm from each other and are oriented in accordance with the ears of the human head, and wherein said at least one microphone comprises a microphone immediately below each pinna replica, each such microphone having unidirectional pickup patterns at an angle of 90° relative to the microphones in the pinna replicas.

8. The stereophonic microphone system according to claim 5, wherein the pinna replicas with microphones are arranged next to each other on a microphone boom, the pinna replicas being mounted in such a way that they do not change direction when the boom is rotated while said at least one microphone localizes a certain sound sought, and means for rotating the boom during recording in accordance with the sound sought.

9. The stereophonic microphone system according to claim 5, wherein the pinna replicas with microphones are arranged at a distance of approximately 18 cm from each other on a microphone boom, the pinna replicas being mounted in such a way that they do not change direction when the boom is rotated while said at least one microphone localizes a certain sound sought, and means for rotating the boom during recording in according with the sound sought.

* * * * *